US010697200B2

(12) United States Patent
Osvatic et al.

(10) Patent No.: US 10,697,200 B2
(45) Date of Patent: Jun. 30, 2020

(54) APPLIANCE LATCH WITH DOOR PRESENCE SENSING

(71) Applicants: ILLINOIS TOOL WORKS INC., Glenview, IL (US); Aileen P. Hapke, Libertyville, IL (US)

(72) Inventors: Michael S. Osvatic, Waukesha, WI (US); Kenyon A. Hapke, Libertyville, IL (US)

(73) Assignee: Illinois Tool Works Inc., Glenview, IL (US)

( * ) Notice: Subject to any disclaimer, the term of this patent is extended or adjusted under 35 U.S.C. 154(b) by 888 days.

(21) Appl. No.: 14/433,049

(22) PCT Filed: Oct. 4, 2013

(86) PCT No.: PCT/US2013/063338
§ 371 (c)(1),
(2) Date: Apr. 2, 2015

(87) PCT Pub. No.: WO2014/058714
PCT Pub. Date: Apr. 17, 2014

(65) Prior Publication Data

US 2015/0240527 A1 Aug. 27, 2015

Related U.S. Application Data

(60) Provisional application No. 61/711,418, filed on Oct. 9, 2012.

(51) Int. Cl.
*E05B 47/00* (2006.01)
*D06F 39/14* (2006.01)
(Continued)

(52) U.S. Cl.
CPC ..... *E05B 47/0001* (2013.01); *D06F 37/42* (2013.01); *D06F 39/14* (2013.01);
(Continued)

(58) Field of Classification Search
CPC ..... D06F 37/42; D06F 39/14; E05B 47/0001; E05B 47/00; E05B 47/0003;
(Continued)

(56) References Cited

U.S. PATENT DOCUMENTS 5,072,974 A * 12/1991 Henne ..... E05C 19/022 292/DIG. 4
5,520,424 A 5/1996 Hapke et al.
(Continued)

FOREIGN PATENT DOCUMENTS

CN 101694055 A 4/2010
WO 2008052060 A2 5/2008

OTHER PUBLICATIONS

ISR for PCT/US2013/063338 dated Apr. 11, 2014.

*Primary Examiner* — Alyson M Merlino
(74) *Attorney, Agent, or Firm* — Boyle Fredrickson, S.C.

(57) ABSTRACT

A door locking mechanism for an appliance provides a bolt that may be moved by an actuator between an extended and retracted position. A bolt stop mechanism blocks movement of the bolt in retraction at one of two positions, depending on how the bolt was extended before the retraction. In this way the bolt automatically retracts when the door is not present because this causes extra extension of the bolt and an over-travel position need not be directly sensed reducing controller complexity or wiring.

14 Claims, 5 Drawing Sheets

(51) Int. Cl.

| | |
|---|---|
| ***D06F 37/42*** | (2006.01) |
| ***E05B 15/00*** | (2006.01) |
| ***E05B 61/00*** | (2006.01) |
| ***E05B 65/06*** | (2006.01) |
| *E05B 9/00* | (2006.01) |

(52) U.S. Cl.
CPC ..... *E05B 15/00* (2013.01); *E05B 61/00* (2013.01); *E05B 65/06* (2013.01); *E05B 2009/004* (2013.01); *Y10T 292/1021* (2015.04)

(58) Field of Classification Search
CPC ..... E05B 47/0005; E05B 15/00; E05B 61/00; E05B 65/06; E05B 47/0012; E05B 2047/0036; E05B 2047/0067; E05B 2047/0068; E05B 2047/0069; E05B 15/0013; Y10T 292/144; Y10T 292/04; Y10T 292/69; Y10T 292/1021
See application file for complete search history.

(56) References Cited

U.S. PATENT DOCUMENTS

| | | | | |
|---|---|---|---|---|
| 5,823,017 | A | 10/1998 | Hapke et al. | |
| 6,363,755 | B1 | 4/2002 | Hapke et al. | |
| 7,150,480 | B2 * | 12/2006 | Lafrenz | D06F 39/12 292/DIG. 69 |
| 7,493,783 | B2 * | 2/2009 | Hapke | D06F 37/42 68/12.26 |
| 7,705,253 | B2 * | 4/2010 | Krieger | D06F 37/42 200/500 |
| 2004/0195844 | A1 | 10/2004 | Lafrenz | |
| 2008/0099314 | A1 | 5/2008 | Krieger et al. | |
| 2010/0052338 | A1 * | 3/2010 | Osvatic | D06F 37/42 292/216 |
| 2011/0016640 | A1 * | 1/2011 | Kim | D06F 37/42 8/137 |

* cited by examiner

APPLIANCE LATCH WITH DOOR PRESENCE SENSING

CROSS-REFERENCE TO RELATED APPLICATIONS

This application is national phase of International Application Number PCT/US2013/063338 filed Oct. 4, 2013 and claims the benefit of U.S. provisional application 61/711,418 filed Oct. 9, 2012 and hereby incorporated by reference.

FIELD OF THE INVENTION

The present invention relates to clothes washing machines and the like and specifically to a door locking mechanism.

BACKGROUND OF THE INVENTION

The spin cycle of a washing machine removes water centrifugally from wet clothes by spinning the clothes at high speed in a spin basket. In order to reduce the possibility of injury to the user during the spin cycle, it is known to use an electronically actuated lock for holding the washing machine door in the closed position.

U.S. Pat. Nos. 6,363,755; 5,823,017; and 5,520,424, assigned to the present assignee and hereby incorporated by reference, describe several locking mechanisms. Desirably, the locking mechanism minimizes projecting parts on the washing machine door which might snag clothing or reduce access to the spin basket, and is simply integrated into the washing machine housing.

A signal indicating the state of the washing machine door as opened or closed may be used to ensure the door is closed before the lock bolt is engaged. Such a signal may be provided by a switch communicating with the washing machine door. Ideally such a switch could not be easily defeated, would operate reliably when used with other washing machine components with normal manufacturing tolerances, and would be resistant to contamination by water and dirt.

U.S. Pat. No. 7,493,783, hereby incorporated by reference, describes a door lock that can sense whether the door is closed by distinguishing between an "over-travel" position of the bolt that can occur when the bolt is extended and the door is up and so does not block the extension of the bolt, and an "engagement" position of the bolt that occurs when the door is down and the bolt is received by the door blocking overextension of the bolt. An appliance controller, by distinguishing between three electrical signals indicating, respectively, the unlock position, the over-travel position, and the lock position, can determine that the door is properly locked with the bolt engaging the door.

Many existing controllers do not have the capability to accommodate additional signals and respond to those signals by retracting the lock. Alternatively, it may be desirable to avoid the extra wiring necessary to communicate an over-travel position to the appliance controller.

SUMMARY OF THE INVENTION

The present invention provides an improved bolt actuator that can eliminate the need to sense and react to the over-travel position thereby allowing it to be used in conventional washing machine control systems without the need for extra wiring to communicate an over-travel signal. Under a proper sequence of bolt movements to lock the door, the bolt will rest at a lock position only when the door is closed and otherwise will rest at the unlock position. In this way, conventional control signals may be accommodated. In addition, the use of only two signals may reduce wiring between the controller and the lock.

Specifically then, the present invention provides an electric lock for a household appliance having a door that may be locked when the door is in a closed position by receipt of a bolt extending from an appliance frame to be received by the door in the closed position. The electric lock includes a lock housing fixable to the appliance frame and a bolt attached to be movable with respect to the housing to extend outward to a lock position when the door is closed and to retract inward to an unlock position when the door is closed allowing the door to move the open position. An actuator system communicates with the bolt to alternately urge the bolt toward the lock position and the unlock position based on at least one signal received from an external appliance control. A bolt stop mechanism communicates with the bolt to block movement of the bolt against retraction at one of the lock and unlock positions depending on and immediately preceding the extension of the bolt.

It is thus a feature of at least one embodiment of the invention to provide a door-sensing lock that automatically retracts the bolt when the door is not closed. In this way additional signals and/or additional control logic is not required of the appliance controller.

The bolt may extend to an over-travel position when the door is not in the closed position and to the lock position having less extension than the over-travel position when the door is in the closed position and the bolt stop mechanism may block movement of the bolt in retraction at one of the lock and unlock positions depending on whether the bolt moved to the locked or over-travel position in the immediately preceding extension of the bolt.

It is thus a feature of at least one embodiment of the invention to sense the position of the door without the need for additional sensors by using bolt extension distance.

The bolt stop mechanism may block movement of the bolt in retraction at the lock position when the door blocks a previous travel of the bolt in extension and the bolt stop mechanism blocks movement of the bolt at the unlock position when the door does not block a previous travel of the bolt in extension.

It is thus a feature of at least one embodiment of the invention to allow a locking position of the bolt only when the door is closed and otherwise to automatically retract the bolt.

The lock may further include contacts providing an electrical signal uniquely identifying that the bolt is in the lock position.

It is thus a feature of at least one embodiment of the invention to provide a traditional "lock" signal used by most controllers to control operation of the appliance.

The contacts may provide only an electrical signal uniquely identifying that the bolt is in the lock position and not distinguishing whether the bolt is in an over-travel position or unlock position.

It is thus a feature of at least one embodiment of the invention to reduce the cost of the wiring harness between the lock and the controller by simplifying the signals that need to be communicated therebetween.

Alternatively, the contacts provide a second electrical signal uniquely identifying that the bolt is in the unlock position.

It is thus a feature of at least one embodiment of the invention to provide a flexible design that can provide for additional unlock confirmation together with automatic bolt retraction.

The bolt stop mechanism may be a track and track-follower together providing bi-stability with successive cycles of extension and retraction when the bolt is blocked by the door and providing monostability with successive cycles of extension and retraction when the bolt is not blocked by the door.

It is thus a feature of at least one embodiment of the invention to provide a simple mechanical element that implements the necessary logic of automatically retracting the bolt if the door is not in position.

The follower is a tip of a flexible spring.

It is thus a feature of at least one embodiment of the invention to provide a mechanism that does not require particular orientation for proper operation of the bi-stable mechanism.

The track may be on the bolt.

It is thus a feature of at least one embodiment of the invention to take advantage of the extent of the bolt by incorporating a portion of the mechanism into the bolt itself.

The actuator system may include an electric motor.

It is thus a feature of at least one embodiment of the invention to provide a rapid low noise actuation compatible with the bi stable mechanism.

The motor may be a DC permanent magnet motor.

It is thus a feature of at least one embodiment of the invention to provide a simple method of providing the two directions of actuation required of the bolt stop mechanism, for example, by reversing the polarity to the motor.

The motor may communicate with the bolt by a pinion gear on a shaft of the motor engaging a rack on the bolt.

It is thus a feature of at least one embodiment of the invention to provide a motor with the linear conversion mechanism providing sufficient mechanical advantage to prevent motor cogging.

The electric lock may further include a door sensor sensing whether the door is in the closed position independent of the bolt position.

It is thus a feature of at least one embodiment of the invention to permit the detection of door position during periods when the lock is not to be actuated, for example, to control the filling cycle in response to the door being open.

These particular objects and advantages may apply to only some embodiments falling within the claims and thus do not define the scope of the invention. Other features and advantages of the invention will become apparent to those skilled in the art upon review of the following detailed description, claims and drawings in which like numerals are used to designate like features.

Figure 1:
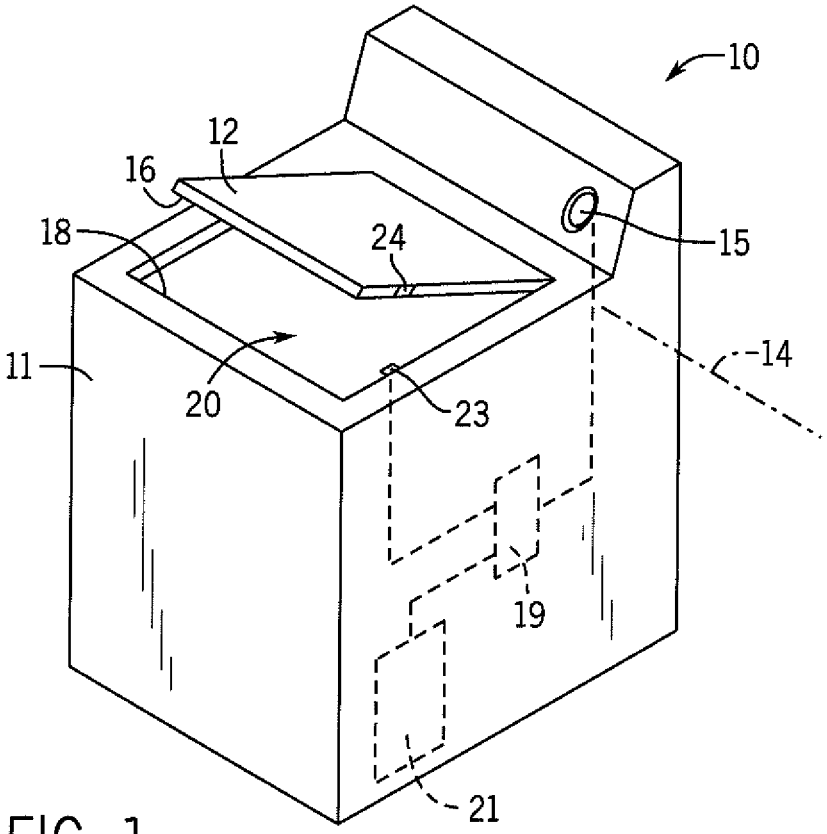
FIG. 1 is a perspective view of a top loading washing machine suitable for use with the present invention showing a strike opening on a side of the opened door of the washing machine and a bolt for engaging the same when the door is closed.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Referring now to FIG. 1, a top loading washing machine 10 suitable for use with the present invention provides a housing 11 supporting a door 12 opening upward about a horizontal door hinge axis 14. The door hinge axis 14 is positioned near the top rear edge of the housing 11 of the washing machine 10 so that a front edge 16 of the door 12 may raise and lower to expose and cover an opening 20 in the housing 11 through which clothing may be inserted into a spin basket (not shown). A front-loading washing machine (not shown) is also suitable for use with the present invention as will be apparent to those of ordinary skill in the art.

The washing machine 10 may include user controls 15, for example, controlling a cycle operation of the washing machine 10 as communicated with a controller 19, for example, a microprocessor or the like executing a stored program. The controller 19 may control appliance actuators 21, for example a spin basket motor, water valves, and the like, which implement the appliance washing functions. The controller 19 may further communicate with an electric lock 23 attached to the housing 11 and serving to lock the door 12 in the closed position under the control of the controller 19 and which may include a door position sensor as will be discussed.

Figure 2:
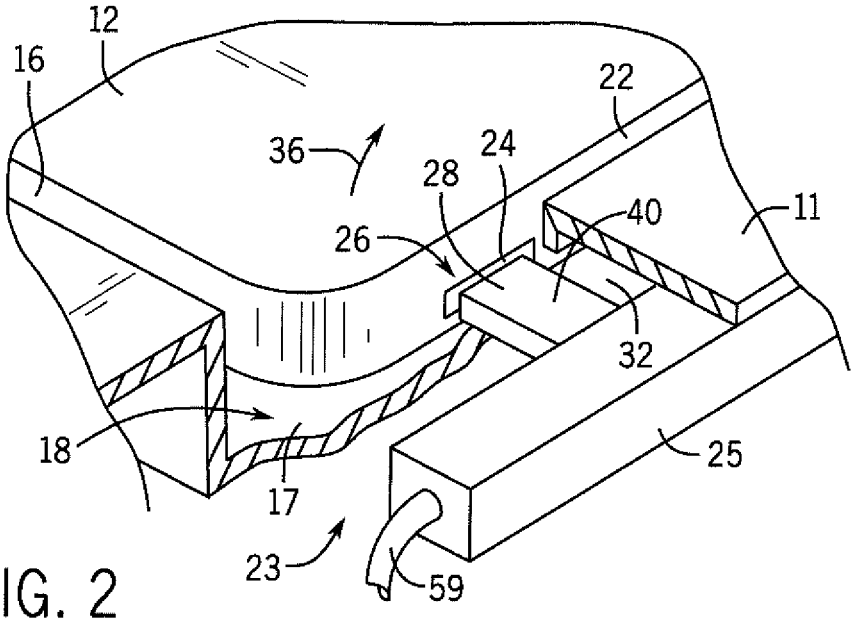
FIG. 2 is a fragmentary cutaway of the portion of the door and washing machine near the bolt of FIG. 1 showing support of a locking mechanism beneath a door well.

Referring now to FIG. 2, when the door 12 is in the closed position, it may sit within a door well 18 having vertical walls 32 surrounding vertical walls 22 of the door 12 and having a horizontal ledge 17 on which the lower surface of the door 12 may rest. A vertical wall 22 of the door 12 near a front edge 16 of the door 12 provides a strike plate 24 having a bolt hole 26.

Figure 3:
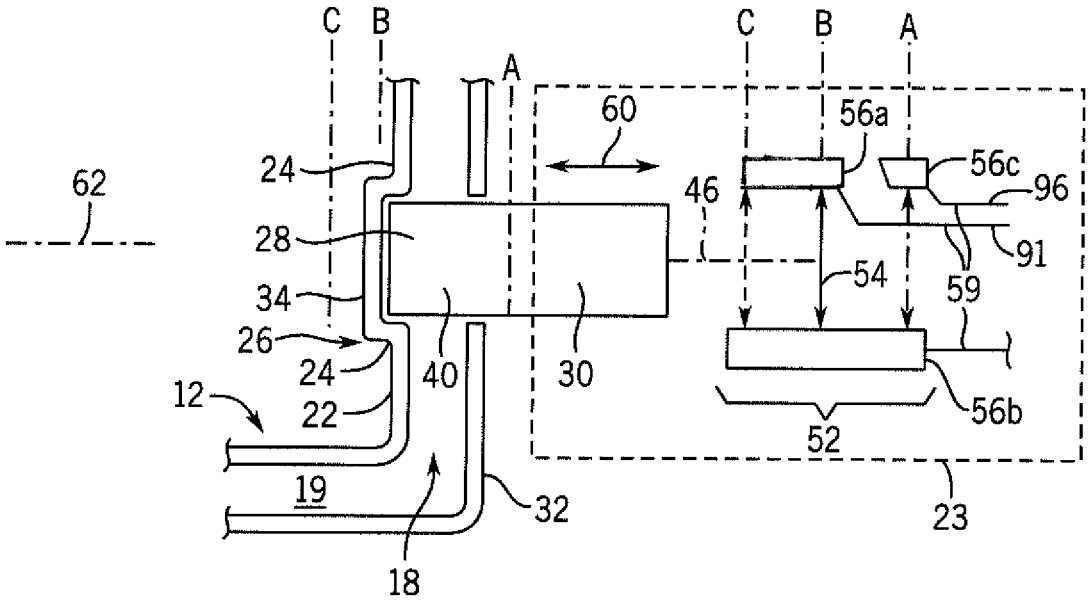
FIG. 3 is a simplified top plan view of the bolt of FIG. 2 extending through a wall of the door well to engage a strike of the door and illustrating an unlock position, lock position, and over-travel position of the bolt and further showing corresponding states of an electrical switch connected to the bolt providing unique indications of whether the bolt is in any of the three positions of unlock, lock, and over-travel.

Referring also to FIG. 3, the bolt hole 26 is sized to receive a leading edge 28 of a lateral extension 40 of a bolt 30 passing horizontally along an axis 62 from a housing 25 of the electric lock 23. The bolt 30 extends from the housing 25 through a vertical wall 32 of the door well 18 opposite the strike plate 24 when the door 12 is closed. When the leading edge 28 of the bolt 30 is engaged in the bolt hole 26, the door 12 may not be raised vertically as indicated by arrow 36 as a result of the lower edge of the bolt hole 26 interfering with a lower face of the leading edge 28.

The leading edge 28 of the bolt 30 may be blocked from further extension by a stop 34 behind the bolt hole 26 when the door 12 is closed. When the door 12 is open, however, the leading edge 28 no longer blocked by the stop 34 may move to an over-extension position as will be described.

Figure 4:
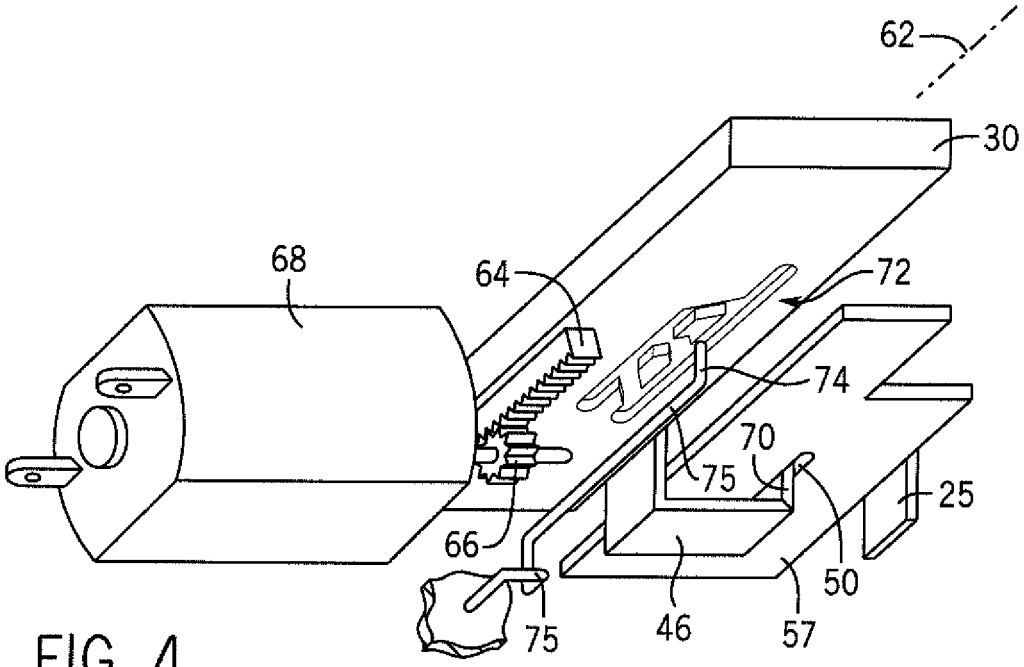
FIG. 4 is a perspective view viewing an underside of the bolt showing an electric motor and rack and pinion mechanism for extending and retracting the bolt and showing a cardioid track and wire-follower controlling a resting position of the bolt depending on a presence or absence of the door and showing the electrical switch communicating with the bolt for detecting bolt position.
Figure 5:
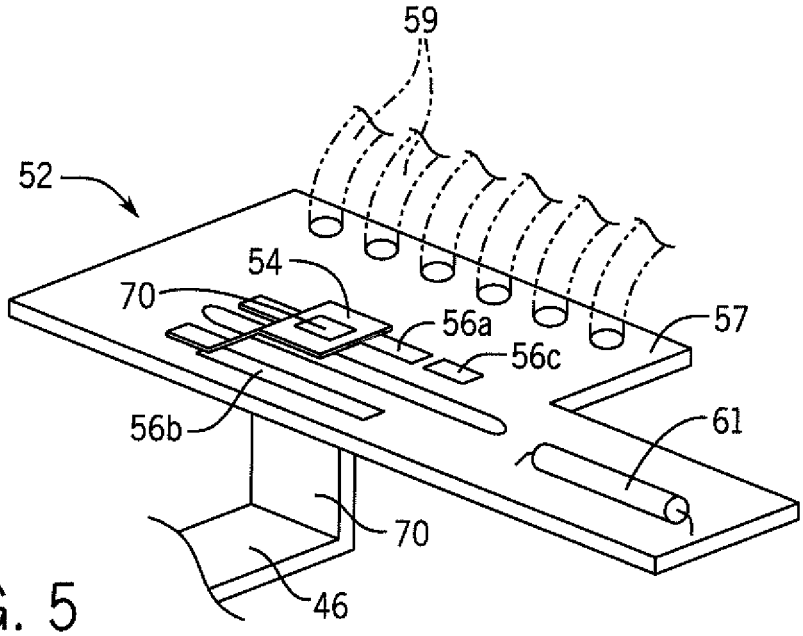
FIG. 5 is a fragmentary top view of the electrical switch of FIG. 4.

Referring now to FIGS. 3, 4 and 5, as will be discussed in detail below, the bolt 30 communicates via a side arm 46 (shown schematically in FIG. 3) with a contact set 52. The contact set 52 provides a two-throw switch in which a pole 54 (attached to the side arm 46) interconnects between respective terminals 56*a*, 56*b*, and 56*c* fashioned on the upper surface of the printed circuit board 57 fixed with respect to the housing 25.

Terminals 56*a* and 56*b* are joined by the conductive pole 54 in a lock position (B) in which the leading edge 28 engages the bolt hole 26 abutting the stop 34 but disconnects between terminals 56*a* and 56*b* and interconnects between respective terminals 56*c* and 56*b* in the unlock position (A) when the leading edge 28 is removed from the bolt hole 26. In an over-travel position (C) where the leading edge extends beyond the lock position not stopped by the stop 34 when the door 12 is open, the pole 54 connects only to terminal 56*a* Accordingly, the unlock position can be uniquely identified, but the lock position and the over-travel position cannot be positively distinguished by means of signals conveyed over separate conductors 59 attached to terminals 56*a* and 56*c* (and a common conductor attached to terminal 56*b*) conveying two signals of unlock signal 96 and lock/over-travel signal 91.

Referring now to FIG. 4, the bolt 30 may be driven along axis 62 by means of a rack gear 64 position on a lower surface of the bolt 30 driven by a pinion gear 66 turned by a DC permanent magnet motor 68 attached to the housing 25. The arm 46 communicating between the bolt 30 and the contact set 52 may extend from a lower surface of the bolt 30 and pass in cantilevered fashion under a pole support element 70, the latter of which passes upward through a slot 50 in the printed circuit board 57 to join with the pole 54 of the contact set 52 described above.

A cardioid track 72 may be provided by means of a groove on the under surface of the bolt 30 to the side of the rack gear 64. An upwardly extending pin 74 being part of a wire form 75 may flex laterally generally perpendicular to axis 62 but may be relatively inflexible along axis 62 with respect to the housing 25. The pin 74 may fit in the groove of the cardioid track 72 to constrain motion of the bolt 30 with respect to the housing 25 as driven by the motor 68 as will be described below.

When the motion of the bolt 30 is constrained by the pin 74 (or by stop 34 in the door shown in FIG. 3) the motor 68 may simply stall for a short period of time and is current limited (for example, by internal resistance) to allow the stall condition to be accommodated. In this way the motor 68 may be driven in an "open-loop fashion" by an appliance controller (not shown).

An upper surface of the printed circuit card may hold a reed switch 61 for detecting a change in a magnetic field caused by closure of the door 12 as described in U.S. Pat. No. 7,493,783 issued Feb. 24, 2009, assigned to the assignee of the present invention, and hereby incorporated by reference. In this way the reed switch 61 provides a separate door closure signal indicating the state of the door 12 as opened or closed.

Figure 6:
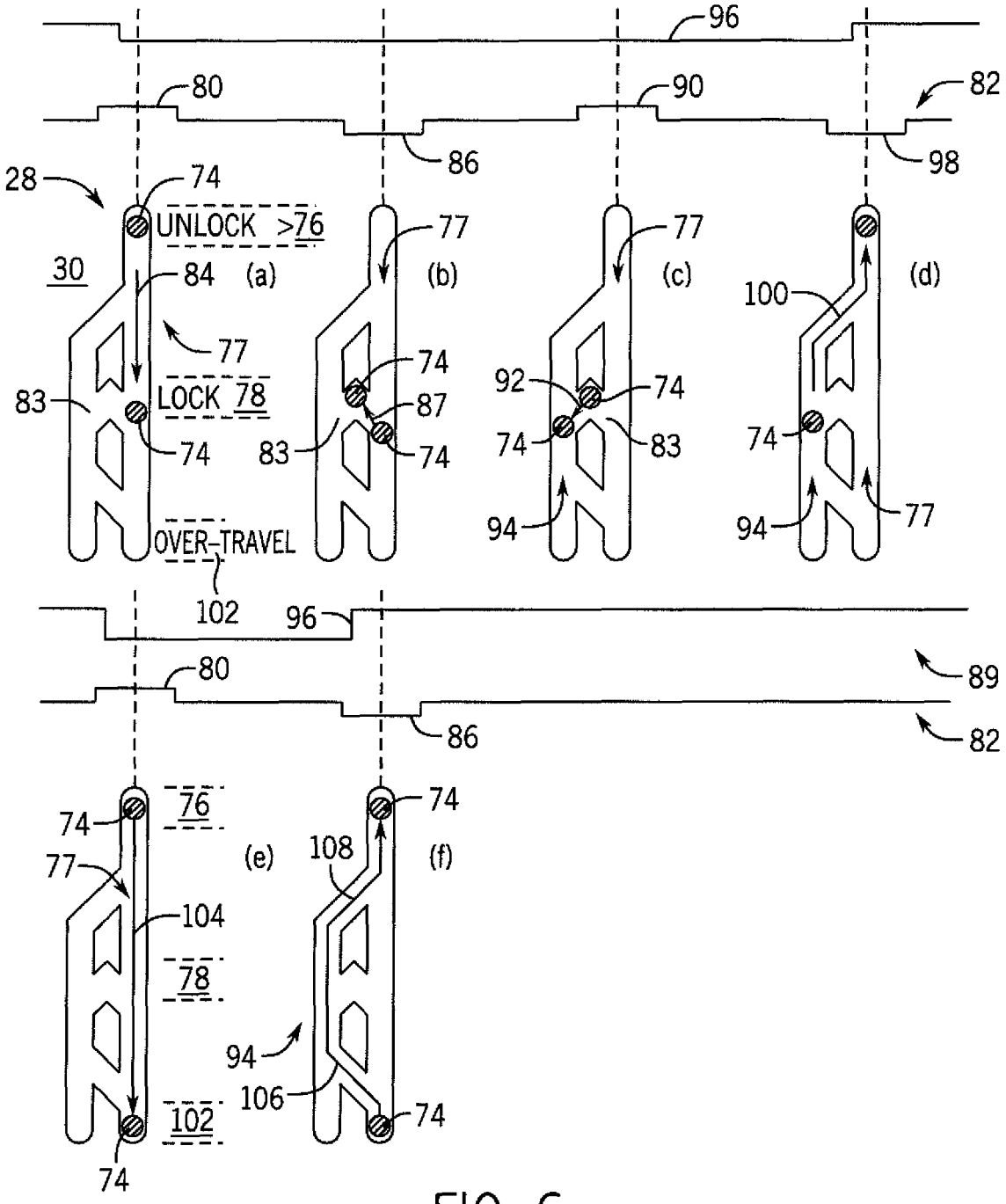
FIGS. 6*a*-6*f* are depictions of the cardioid track of the bolt of FIG. 4 in various positions together providing a diagram of movement of the cardioid track with respect to the wire-follower for two conditions where the door is present or absent and showing states of sensor switches during those movements.

Referring now to FIG. 6*a*, with the bolt 30 in the unlock position fully withdrawn from the door 12, the pin 74 will be in a unlock zone 76 at one extreme end of an axial track 77 of the multi-path cardioid track 72 near the leading edge 28 of the bolt 30. In this position, the pin 74 will block further retraction of the bolt 30.

Figure 7:
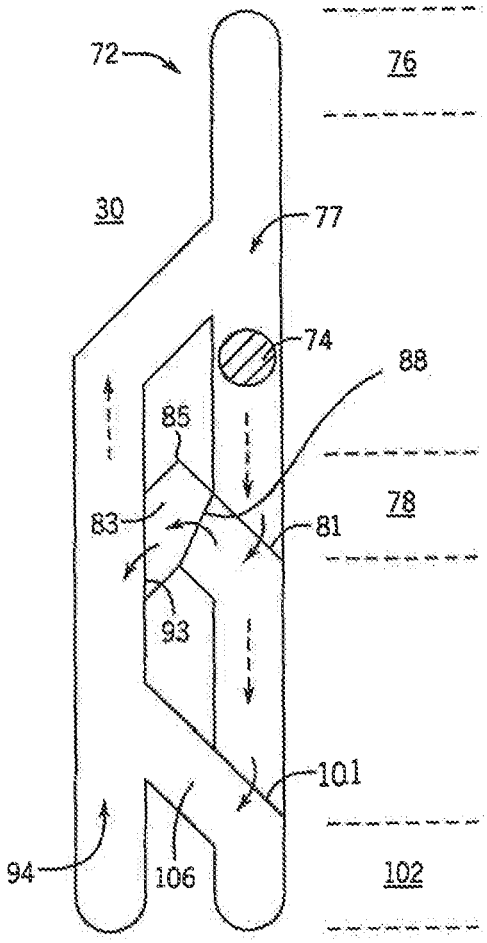
FIG. 7 is a detailed perspective view of the ramps and levels of the cardioid track of FIG. 5 promoting a bi-stable operation.

When the door 12 is closed and the motor 68 is reversed by means of a positive polarity pulse 80 of motor current 82 from the appliance controller 19, the bolt 30 will extend to hit stop 34 (shown in FIG. 3) and the pin 74 will move to a lock zone 78 adjacent to a branching cross-track 83 of the cardioid track 72 as indicated by arrow 84. As noted, further motion of the bolt 30 is blocked by an abutment of the bolt 30 with the stop 34. Referring also to FIG. 7, when the pin 74 is adjacent to the branching cross-track 83 it will pass and drop down (with respect to the bolt 30) over a ledge 81 in the cardioid track 72 urged by a spring bias of the wire form 75.

Referring to FIGS. 6*b* and 7, a reverse polarity pulse 86 of motor current 82 provided by a central controller 19 will then cause the pin 74 to move into the cross-track 83 as guided by the ledge 81. There, the pin 74 is captured by an apical notch 85, as indicated by arrow 87, preventing further retraction of the bolt 30 and maintaining engagement between the bolt 30 and the bolt hole 26 of the door 12. In arriving at the apical notch 85, the pin 74 drops over a ledge 88 blocking its regression along cross-track 83.

Referring momentarily also to FIG. 3, when the pin 74 is thought to be within the lock zone 78, the contact set 52 may provide a unlock signal 96 indicating that the lock is in the unlock zone 76. For reasons of tolerances, the absence of the unlock signal 96 is used to confirm the correct location of the pin 74 in the area of the lock zone 78

Referring to FIGS. 6*c* and 7, the appliance controller 19 in a final step of locking the door 12 may then provide another positive polarity pulse 90 to the motor 68 which moves the pin 74 as indicated by arrow 92 to a position within a second axial track 94 generally parallel to axial track 77 but displaced to the side thereof. In arriving at the second axial track 94, the pin drops over a ledge 93 preventing retraction into the cross-track 83. This new position is still adjacent to the cross-track 83 with further extension of the bolt 30 blocked by the stop 34 shown in FIG. 3. This position provides a locking with full engagement of the bolt 30 with the bolt hole 26 despite possible variations in the separation of the door 12 from the wall 32 caused by manufacturing tolerances. This final positive polarity pulse 90 may be provided only when there has been confirmation that the door is in place by a checking that there is no continuity through interconnection of terminals 56*b* and 56*c*, that is, no unlock signal 96. Referring to FIGS. 6*d* and 7, when it is desired to unlock the door 12, another reverse polarity pulse 98 may be applied to the motor 68, this current 82 causing the pin 74 to move along the axial track 94 as indicated by arrow 100 back to the unlock zone 76.

Referring now to FIG. 6*e* and considering the case where the door 12 is open and the stop 34 displaced from interaction with the bolt 30 (counter to that as shown in FIG. 3), the positive pulse 80 may be applied to the motor 68 when the bolt 30 is in the full unlock position with the pin 74 in unlock zone 76. As with the case of FIG. 6*a*, this pulse 80 will cause the pin 74 to move along the axial track 77, but in this case past the cross-track 83 to an over-travel zone 102 at an opposite end of axial track 77 as indicated by arrow 104. In reaching this over-travel zone 102, the pin must drop over a ledge 101 even with a bypass track 106. The subsequent reverse polarity pulse 86 will then cause the pin 74 to pass along bypass track 106 guided by ledge 101 from axial track 77 to axial track 94 to pass all the way back to the unlock zone 76 as indicated by arrow 108 bypassing the lock zone 78.

Unlike the situation described with respect to FIG. 6*b*, at the conclusion of this negative pulse 86, the pin 74 will not be in the lock zone 78 but rather at the unlock zone 76 and accordingly there will be a signal on unlock signal line 96 at the conclusion of these motions clearly discriminating from the case of FIG. 6*b* and indicating that the door 12 is not in the closed position. This determination will cause the motor controller to eliminate subsequent pulses 90 and 98 and may be used to prevent a starting of an appliance motor such as a washtub motor or the like. The retraction of the bolt to the unlock zone 76 brings it out of interference with the door should the door 12 be subsequently closed.

As will be understood from the above discussion, the controller 19 may investigate the contact set 52 after the pulses 80 and 86 to determine whether the appliance should be activated as properly locked without the need for additional analysis or retraction of the bolt 30.

It is specifically intended that the present invention not be limited to the embodiments and illustrations contained herein, but include modified forms of those embodiments including portions of the embodiments and combinations of elements of different embodiments as come within the scope of the following claims. Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. An electric lock for a household appliance having a door that may be locked when the door is in a closed position, the electric lock comprising:

a housing fixable to an appliance frame;

a bolt attached to be movable with respect to the housing so as to:

extend outward to a lock position with respect to the appliance frame so as to lock the door when the door is in the closed position;

retract inward to an unlock position with respect to the appliance frame so as to unlock the door when the door is in the closed position thereby allowing the door to open to an open position;

extend outwardly beyond the lock position to an over-travel position with respect to the appliance frame when the door is in the open position;

an electric actuator system communicating with the bolt to alternately urge the bolt toward the lock position and the unlock position based on at least one signal received from an external appliance control; and a bolt stop mechanism communicating with the bolt to block movement of the bolt by the electric actuator system against first and second mechanical stops of the bolt stop mechanism having predetermined fixed locations at the lock and unlock positions, respectively, and operating to selectively block movement of the bolt against retraction against one of the first and second mechanical stops at one of the lock and unlock positions depending on an immediately preceding amount of extension of the bolt with the bolt stop mechanism providing different bolt actuation modes based on whether the door is in the closed position or the open position, wherein the bolt stop mechanism provides:

bi-stability with successive cycles of the electric actuator system to alternately urge the bolt between the lock position and the unlock position when the door is in the closed position; and mono-stability with successive cycles of the electric actuator system to repeatedly urge the bolt to the over-travel position and automatically return to the unlocked position when the door is in the open position.

2. The electric lock of claim 1 wherein the electric actuator system includes an electric motor.

3. The electric lock of claim 2 wherein the electric motor is a DC permanent magnet motor.

4. The electric lock of claim 2 wherein the electric motor communicates with the bolt by a pinion on a shaft of the electric motor engaging with a rack on the bolt.

5. The electric lock of claim 1 further including contacts providing a first signal when the bolt is in the lock position or the over-travel position and a second signal when the bolt is in the unlock position, the first and second signals each being conveyed as a presence or absence of a voltage on a single respective conductor.

6. The electric lock of claim 1 further including a door sensor sensing whether the door is in the closed position, independent of the position of the bolt.

7. An electric lock for a household appliance having a door that may be locked when the door is in a closed position, the electric lock comprising:

a housing fixable to an appliance frame;

a bolt attached to be movable with respect to the housing so as to extend outward to a lock position with respect to the appliance frame so as to lock the door when the door is in the closed position and to retract inward to an unlock position with respect to the appliance frame so as to unlock the door when the door is in the closed position thereby allowing the door to open;

an electric actuator system communicating with the bolt to alternately urge the bolt toward the lock position and the unlock position based on at least one signal received from an external appliance control;

a bolt stop mechanism communicating with the bolt to block movement of the bolt by the electric actuator system against first and second mechanical stops of the bolt stop mechanism having predetermined fixed locations at the lock and unlock positions, respectively, and operating to selectively block movement of the bolt against retraction against one of the first and second mechanical stops at one of the lock and unlock positions depending on an immediately preceding amount of extension of the bolt; and wherein the bolt extends to an over-travel position when the door is not in the closed position, and the bolt extends to the lock position having less extension than the over-travel position when the door is in the closed position and wherein the bolt stop mechanism blocks movement of the bolt in retraction at one of the lock and unlock positions depending on whether the bolt has moved to the lock or over-travel position in the immediately preceding extension of the bolt.

8. The electric lock of claim 7 wherein the bolt stop mechanism blocks movement of the bolt in a direction of retraction when the door blocks a previous travel of the bolt in a direction of extension and the bolt stop mechanism blocks movement of the bolt in a direction of retraction at the unlock position when the door does not block a previous travel of the bolt in a direction of extension.

9. The electric lock of claim 8 further including contacts providing a first electrical signal identifying that the bolt is not in the lock position.

10. The electric lock of claim 9 wherein the contacts provide a second electrical signal identifying that the bolt is in the lock position or in the over-travel position.

11. The electric lock of claim 9 wherein the first electrical signal uniquely identifies that the bolt is in the unlock position.

12. The electric lock of claim 8 wherein the bolt stop mechanism comprises a track and track-follower together providing blocking in retraction at two successive predefined locations with successive cycles of extension and retraction, when the bolt is blocked by the door, and providing blocking in retraction at only a single predefined location with successive cycles of extension and retraction, when the bolt is not blocked by the door.

13. The electric lock of claim 12 wherein the track-follower is a tip of a flexible spring.

14. The electric lock of claim 12 wherein the track is on the bolt.

* * * * *